United States Patent [19]

Byers et al.

[11] 4,333,401

[45] Jun. 8, 1982

[54] HAND GRENADE

[75] Inventors: Charles M. Byers, 2105 S. Hardy Dr., Tempe, Ariz. 85282; Jody L. Numbers, Scottsdale, Ariz.

[73] Assignee: Charles M. Byers, Tempe, Ariz.

[21] Appl. No.: 66,289

[22] Filed: Aug. 13, 1979

[51] Int. Cl.[3] ..... F42B 27/08

[52] U.S. Cl. ..... 102/487

[58] Field of Search ..... 102/64, 65, 238, 261, 102/260, 368, 482, 486, 487

[56] References Cited

U.S. PATENT DOCUMENTS

| | | | |
|---|---|---|---|
| 2,079,008 | 5/1937 | Goss | 102/261 |
| 2,737,116 | 3/1956 | Manzolini | 102/487 |
| 3,103,171 | 9/1963 | Jans | 102/64 |
| 3,392,671 | 7/1968 | Hinzmann | 102/64 |
| 3,434,421 | 3/1969 | Berlin | 102/64 |
| 3,685,451 | 8/1972 | Bowring | 102/64 |
| 3,865,035 | 2/1975 | Munson | 102/66 |
| 4,192,236 | 3/1980 | Scott | 102/61 |

FOREIGN PATENT DOCUMENTS

| | | | |
|---|---|---|---|
| 629069 | 11/1927 | France | 102/65 |
| 275830 | 9/1927 | United Kingdom . | |
| 276279 | 9/1927 | United Kingdom . | |

*Primary Examiner*—Richard E. Schafer
*Assistant Examiner*—Edward F. Miles
*Attorney, Agent, or Firm*—Warren F. B. Lindsley

[57] ABSTRACT

An improved hand grenade incorporating safety features including a normally uncocked striker arm and a protective shield over the primer. Because the striker spring is normally unstressed, the major working parts of the grenade may be inexpensively made from plastics.

7 Claims, 9 Drawing Figures

HAND GRENADE

BACKGROUND OF THE INVENTION

The hand grenade has been used as a weapon in warfare since the fifteenth century. During the seventeenth and eighteenth centuries specially trained men known as grenadiers were armed with hand grenades. In World Wars I and II all armies had them and they have been employed effectively in the more recent conflicts including the Korean and Vietnamese wars and in guerrilla activities all over the world.

A grenade is a small explosive bomb with the first grenades looking like pomegranates. Presently, there are fragmentation granades with cast iron or steel containers that shatter into many pieces when they explode and chemical grenades comprising steel containers filled with phosphorous, tear gas or smoke producing materials. These grenades may be thrown by hand, fired from a hand-held weapon or hurled from a grenade launcher.

The modern hand grenade typically comprises a cast iron or steel body which holds the explosive charge, a detonator which ignites the charge, a time delay train leading to the detonator, a primer, a striker, a striker spring, a safety lever and a safety pin. The striker is always in the cocked position from the time of manufacture with the striker spring under pressure. A catch at one end of the safety lever restrains the striker so long as the lever is held against the body of the grenade, and the safety pin secures the position of the safety lever until the pin is pulled.

When using the grenade it is grasped in the throwing hand with the safety lever held against the body of the grenade. The safety pin is then removed. As the grenade leaves the hand during the course of its being thrown toward a target, the safety lever springs outward releasing the striker. The striker impacts the primer igniting the time delay train. The time delay train begins burning at one end and the burning progresses toward the opposite end at a relatively low rate of travel. After a predetermined period of time, the burning reaches the detonator, the detonator fires and ignites the explosive charge causing the body of the grenade to explode, scattering fragmented shrapnel over the target area. If the device is a chemical grenade it gives off smoke or tear gas when ignited.

Grenades of this type have been made almost entirely of metal, including the body, the safety lever and the striker mechanism. Fabrication from metal has been necessary in order to assure safety for the user. Because the striker is always in the cocked position, materials have had to be employed that are not subject to creepage which might result in a premature release of the striker mechanism. Fabrication from plastics has thus been precluded and the cost of the grenade has accordingly remained relatively high.

Even when fabricated from metal, the present grenade design with its normally-cocked striker is inherently unsafe. From the aspect of safety an improvement could be achieved in a design configuration employing a striker mechanism that is not cocked until use is imminent.

An improved grenade design is thus much to be desired. In particular, such a design should be made inherently safe for the user even when fabricated from inexpensive plastic materials.

SUMMARY OF THE INVENTION

In accordance with the invention claimed, an improved hand grenade is provided in a form which is inherently less hazardous to the user even when fabricated inexpensively from plastic materials.

It is, therefore, one object of this invention to provide an improved hand grenade.

Another object of this invention is to provide an improved hand grenade which is inherently safe for the user.

A further object of this invention is to provide an improved hand grenade in which added assurance of safety is provided through the use of a striker mechanism that is not cocked until immediately prior to the use of the grenade.

A still further object of this invention is to provide an improved hand grenade which may be fabricated inexpensively from plastic materials without compromising the safety of the device.

Yet another object of this invention is to provide an improved hand grenade which affords in addition to the foregoing benefits a means for selecting either of two operating modes; including a choice of smoke or tear gas emission or a bursting mode.

Further objects and advantages of the invention will become apparent as the following description proceeds, and the features of novelty which characterize the invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
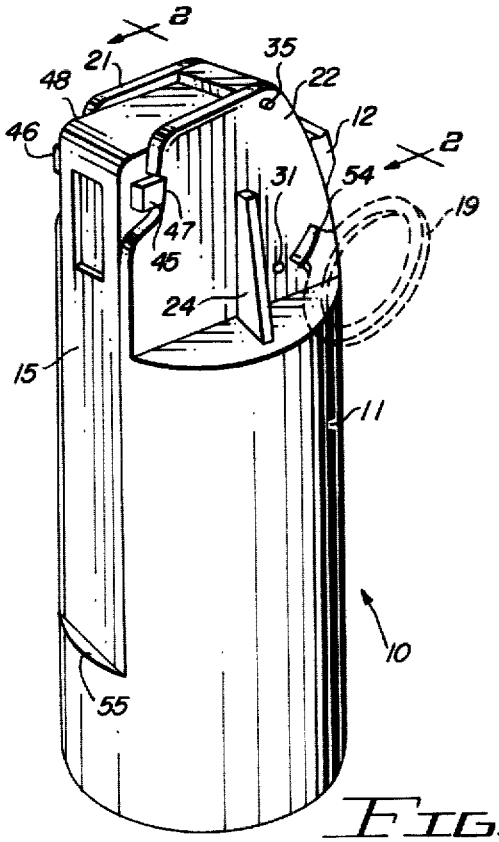
FIG. 1 is a perspective side view of the improved hand grenade of the invention.

Referring more particularly to the drawings by characters of reference, FIGS. 1–6B disclose an improved hand grenade 10 comprising a body 11, a striker arm 12, a striker spring 13, a sear 14, a safety lever 15, a primer 16, a time delay train 17, a chamber 18 for holding the explosive charge, and a safety pin 19.

The body 11 is generally cylindrical and it has two parallel plates 21 and 22 extending upward from its upper end. Reinforcing ribs 23 and 24 secure the upright position of plates 21 and 22, respectively. The lower cylindrical portion of the body 11 houses the time delay train 17 and the chamber 18; plates 21 and 22 serve as a mounting frame for striker arm 12 and safety lever 15.

Striker arm 12 has two curved side members 25 and 26 joined at their ends by transverse webs 27 and 28 in a form resembling a picture frame. The forward web 27 supports near its center a firing pin 29 as shown most clearly in FIG. 4B. The rearward web 28 serves as a finger grip for cocking the striker mechanism. The lengths of the webs 27 and 28 are somewhat shorter than the separation distance between plates 21 and 22 so that striker arm 12 passes freely between plates 21 and 22. A pivot pin 31 passes through corresponding points near the centers of side members 25 and 26 and through aligned holes in plates 21 and 22 to pivotally mount arm 12 between plates 21 and 22. This pin may be made of plastic and molded integrally with the striker arm. Striker spring 13 is mounted over the center portion of pin 31 with one end 32 bearing against the underside of web 28 and its other end 33 bearing against the top surface of a tapered upper edge 34 of body 11. Ends 32 and 33 are in compression against the torsional force of spring 13 and they urge the web 28 upward, applying a counterclockwise moment of force against arm 12 about pin 31. If arm 12 is unrestrained by other mechanisms, it is forced to rotate in a counterclockwise direction as viewed in FIG. 4C until firing pin 29 strikes the center of the primer 16 which is located near the edge of the top surface of body 11 at a position directly opposite edge 34.

Safety lever 15 has the general form of an inverted "L". The outer tip of the shorter leg that is ordinarily the base of the "L" is pivotally mounted between plates 21 and 22 by means of a pivot pin 35. Pin 35 passes perpendicularly through plates 21 and 22 at a position directly above edge 34 with clearance provided between pin 35 and edge 34 for the rotational movement of striker arm 12.

Figure 4A:
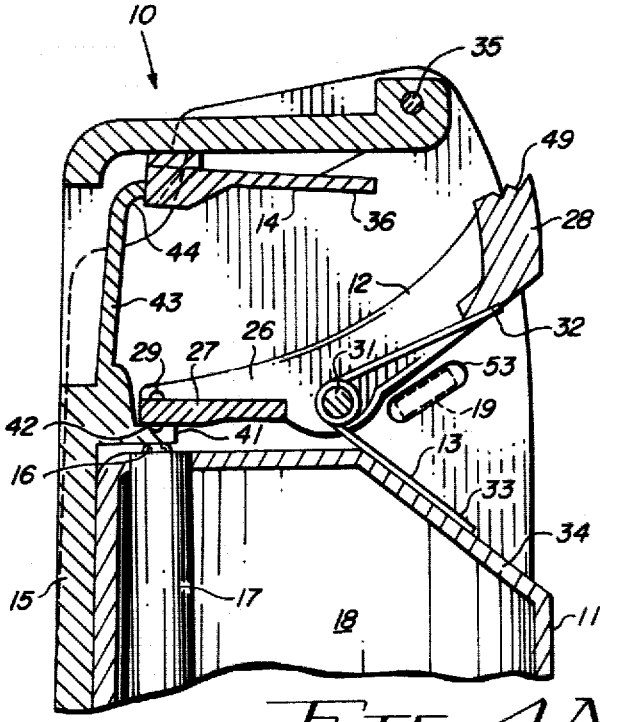
FIG. 4A is a cross-sectional view of the upper portion of the grenade of FIGS. 1–3 as viewed along line 4—4 of FIG. 2.
Figure 2:
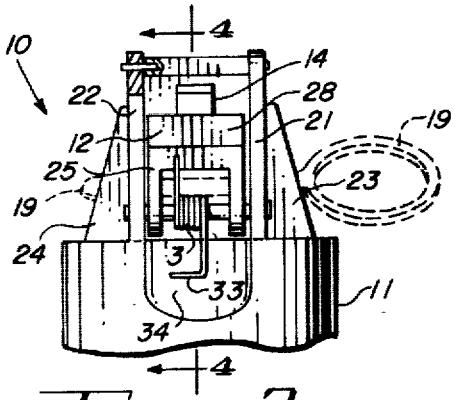
FIG. 2 is a perspective view of the upper portion of the grenade of FIG. 1 taken along line 2—2 of FIG. 1.
Figure 3:
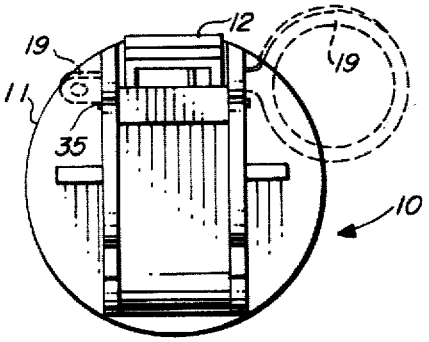
FIG. 3 is a top view of the grenade of FIG. 1.
Figure 4B:
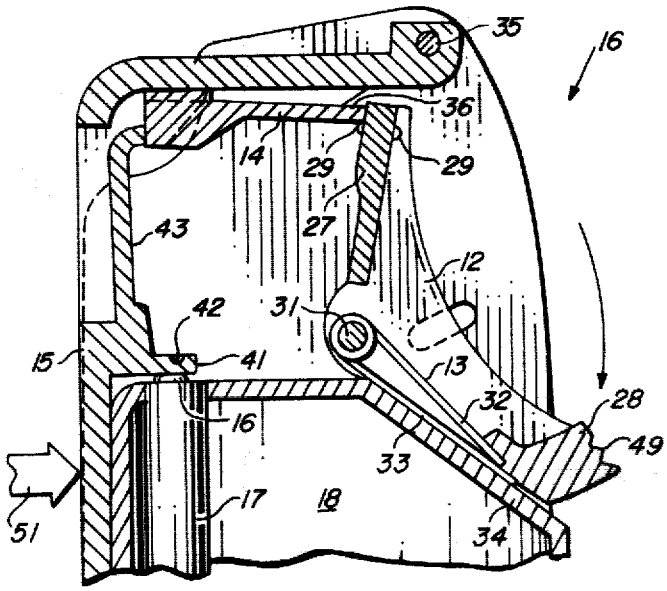
FIG. 4B is another cross-sectional view taken along line 4—4 of FIG. 2 but with the striker set to the cocked position.
Figure 4C:
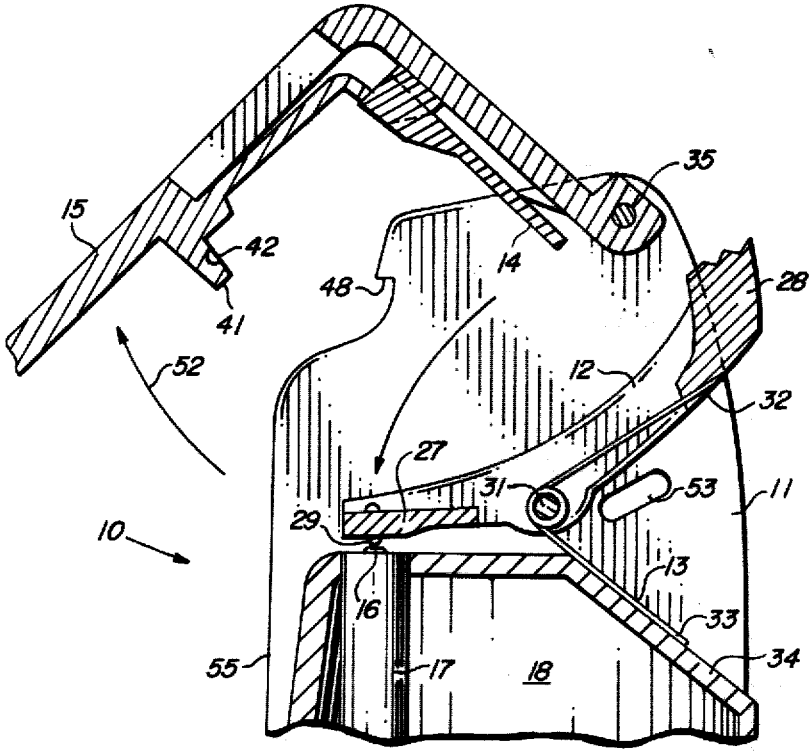
FIG. 4C is yet another cross-sectional view taken along line 4—4 of FIG. 2 but showing the striker in the position of impact with the primer.

As may be noted from a comparison of FIGS. 1, 4A 4B and 4C, lever 15 moves rotationally about pin 35 from a downward position, in which the longer leg of the "L" rests against a depression in the side of body 11, to the extended or lifted position shown in FIG. 4C.

Figure 5:
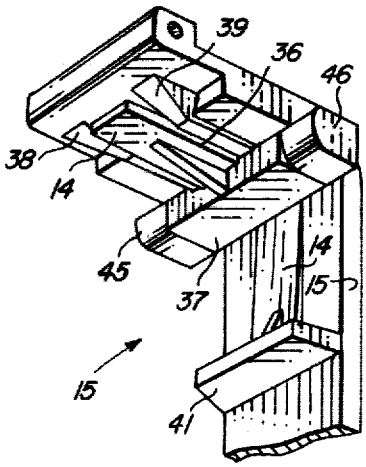
FIG. 5 is a perspective view of a portion of the safety lever structure.

The sear 14 is "T"-shaped, comprising a vertical leg or sear bar 36, and a cross-piece 37. As shown in FIG. 5, bar 36 and cross-piece 37 form an integral one-piece member with cross-piece 37 arranged perpendicularly across the top surface of bar 36 at one end of bar 36. A spreading wedgeshaped projection from the opposite face of bar 36 at the same end is slidably captured between two parallel undercut rails 38 and 39 which project downward from the underside of the shorter leg of the "L"-shaped lever 15. The sliding motion of the sear 14 within rails 38 and 39 is in a direction parallel with the plates 21 and 22 of body 11.

On the side of lever 15 facing the body 11 at a point just above the top surface of the cylindrical portion of body 11 a flat horizontal tab 41 extends inward, barely clearing the primer 16 vertically and completely covering primer 16 when lever 15 is lowered against body 11. A depression 42 in the center of the top surface of tab 41 directly above the primer 16 receives the tip of the firing pin 29 when the striker arm 12 is set in the safety position as shown in FIGS. 1 and 4A.

Extending upward from the base of tab 41 in a direction parallel with the larger vertical leg of lever 15 is a sear spring 43. Sear spring 43 is integral with lever 15. Spring 43 is a flat cantilevered strip with its tip 44 bent perpendicularly toward the end of the sear 14. As shown in FIG. 4A the spring 43 drives the sear 14 to the right and away from the longer leg of lever 15.

Referring again to FIG. 5, it will be noted that the ends 45 and 46 of cross-piece 37 extend beyond the edges of lever 15. As shown in FIG. 1, the ends 45 and 46 also extend past the edges of plates 21 and 22, and, in the lowered position of lever 15 they are captured in notches 47 and 48 which are formed in the edges of plates 21 and 22. In this position of the lever 15 the spring 43 drives the sear 14 to the right, urging the ends 45 and 46 into the notches 47 and 48. The capture of ends 45 and 46 by the notches 47 and 48 in this manner secures the downward position of the lever 15 as shown in FIGS. 1 and 4A. This is the uncocked condition of the grenade 10 in which the force of the spring 13 is substantially relaxed, the primer is guarded by the tab 41, and the position of the safety lever 15 is secured by the captured cross-piece 37 with help from the capture of the lower end of the firing pin 29 in the depression 42 of tab 41.

To cock the striker arm 12 the longer leg of lever 15 is held against body 11 while applying a downward force to the serrated top surface 49 of web 28. Arm 12 is caused thusly to rotate in a clockwise direction. Concurrently, the web 27 at the opposite end of arm 12 is caused to move arcuately upward and to the right. As web 27 moves past bar 36 of sear 14, its outer edge impinges against the under surface of bar 36 deflecting bar 36 upward, then moving past its edge just prior to reaching the clockwise rotational limit of arm 12. As pressure is subsequently released from surface 49, spring 13 urges arm 12 in a counterclockwise direction until the top of web 27 impinges against the end of bar 36 driving bar 36 and sear 14 leftward against the lesser force of spring 43 and releasing ends 45 and 46 from the notches 47 and 48. FIG. 1 shows the association of releasing end 45 and notch 47 with releasing end 46 and notch 48 being similarly arranged. This is the cocked condition of the grenade 10, and to prevent the striker arm 12 from being fully released, it is necessary to hold the lever 15 against the body 11 until the instant the grenade leaves the user's hand in the process of being thrown.

It will be noted that in the unlikely event that the bar 37 should break and thereby release arm 12 under the force of the spring 13, the firing pin will simply impact the tab 42 which remains in position over the primer 16 so long as lever 15 is held against body 11. The primer 16 is thus prevented from firing.

In the normal manner of dispatching the grenade, the tab or safety pin 19 is pulled and then the grenade is set to the cocked position just described and as illustrated in FIG. 4B. As the grenade then leaves the hand in the process of being thrown, the force 51 against lever 15 is released. Simultaneously, the force of spring 13 driving web 27 against the end of bar 36 causes lever 15 to swing outward in the direction 52 as shown in FIG. 4C. Bar 36 at the same time moves away from its position of restraint against the clockwise rotation of arm 12, and arm 12 is released with the result that it rotates very rapidly to its counterclockwise position causing pin 29 to impact and fire the primer 16. As the primer 16 is fired it ignites the time delay train 17 which burns at a controlled rate to initiate the detonation of the explosive charge in chamber 11 at a predetermined time later. As shown in FIGS. 4A, 4B and 4C, the time delay train 17 is generally cylindrical and it extends vertically downward from a point directly under primer 16 into the center of the chamber 18.

As an added measure of safety, the safety pin 19 may be employed to prevent the cocking of the grenade. As shown in FIGS. 1 and 4A the body of the pin 19 is passed through two holes 53 and 54 in plates 21 and 22, respectively. The holes 53 and 54 are positioned in plates 21 and 22 such that when arm 12 is in the uncocked position of FIGS. 1 and 4A the body of pin 19 passes under arm 12, in which position it prevents arm 12 from being rotated in the clockwise direction for cocking.

Because the striker arm is left in the uncocked position until just prior to the use of the grenade 10, and because the spring 13 is thus normally in a relaxed condition, the major parts of the grenade (with the exception of the spring 13, the firing pin 29, the primer 16 and the pivot pins 31 and 35) may be inexpensively made of plastic by injection molding. This is in contrast with the conventional grenade in which the normally cocked striker mechanisms would be subject to creepage and failure if they were made of plastic.

The intentionally smooth and flush contours of the grenade 10 as shown particularly in FIG. 1 permit the grenade to be fired from a grenade launcher. As noted from FIG. 1, the safety lever 15 when held in the safety position rests in a groove 55 which extends longitudinally down the side of the body 11.

Figure 6B:
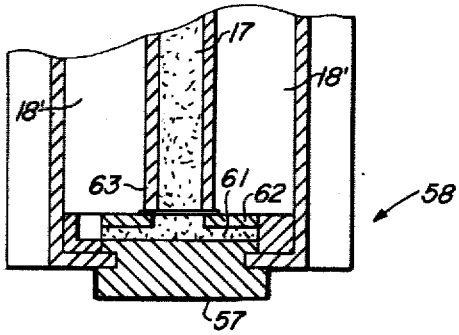
FIG. 6B is a cross-sectional view of FIG. 6A taken along the line 6B—6B.
Figure 6A:
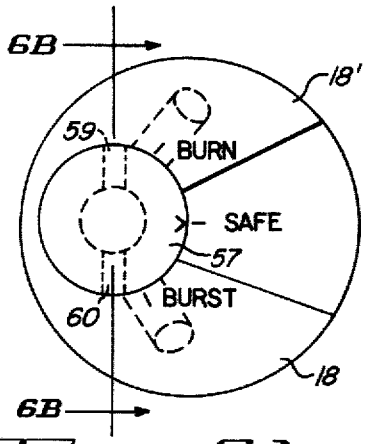
FIG. 6A is a bottom end view of a modification of the hand grenade shown in FIGS. 1–5 illustrating a dial for selecting either of two operating modes of the grenade.

FIGS. 6A and 6B disclose a modification which affords in addition to the benefits described above for the structure shown in FIGS. 1-5 a dial or selector means 57 for selecting either one of two operating modes, i.e. a burning mode for smoke or tear gas grenades or a bursting mode. In this modification the hand grenade 58 comprises all of the structure described in the description of FIGS. 1-5 but differs therefrom by having an additional chamber 18'. Chamber 18 contains the explosive charge while chamber 18' contains a burning charge.

Thus, the user may preselect the operating mode of the grenade at any time prior to throwing it by selectively rotating the dial 57 from a "safe" position to either the "burn" or "burst" positions shown. The dial or selector means comprises a circular configuration having a pair of passageways 59 and 60 extending radially outwardly of an interconnecting passageway 61 which is axially aligned with the primer train as shown in FIG. 6B. It should be noted that a sliding fit of close limits should be provided between the top surface 62 of dial 57 and the end of the passageway 63 of time delay train 17 so that the burning powder of the time delay train 17 cannot bypass the passageways by flashing out between the top surface 62 of dial 57 and ignite the materials in the non-selected chambers 18, 18' or both.

Although but a few embodiments of the invention have been shown and described, it will be apparent to those skilled in the art that various changes and modifications may be made therein without departing from the spirit of the invention or from the scope of the appended claims.

We claim:

1. A hand grenade having a striker mechanism that is uncocked until immediately prior to the use of the grenade, the hand grenade comprising:

an elongated hollow close-ended body member, a striker arm pivotally mounted on the outside periphery of one end of said body member, a firing pin mounted on and adjacent one end of said striker arm, a primer mounted on said one end of said body member, a first spring means for biasing said striker arm in one direction to cause said firing pin to move toward said primer, a time delay train mounted in said body member in burning association with said primer, at least one ignitable charge mounted in said body member for actuation by said train, a safety lever pivotally mounted on said body member, said safety lever comprising an L-shaped configuration, one leg of which extends across said one end and is pivotally mounted to said body member and its other leg arranged in one position to extend longitudinally of said body member and movable to a position laterally of said body member, a sear arranged to extend juxtapositioned to said one leg of said lever for limited movement therealong, a second spring means comprising a flat cantilevered strip connected at one end to said other leg of said lever and at its other end to said sear for normally biasing said sear away from said other leg of said lever and along said one leg of said lever, a tab comprising a part of said other leg of said lever for extending over said primer and in the path of movement of said firing pin when said other leg of said lever is positioned longitudinally of said body member, said first spring means biasing the firing pin of said striker arm into engagement with said tab when said first spring means is in its extended condition and said other leg of said lever is longitudinally of said body members, and means mounted on said striker arm for rotating said striker arm in a second direction to bias said first spring means and cause said one end of said striker arm to engage said sear and to move it longitudinally of said one leg of said lever to bias said second spring means and said other leg of said lever to a position longitudinally of said body member, said other leg of said lever being hand-held against said body and when released, moving laterally of said body member under the bias of said second spring means thereby moving said sear out of engagement with said striker arm and said tab out of blocking engagement with said primer, said first spring means then biasing said firing pin into engagement with said primer.

2. The hand grenade set forth in claim 1 wherein:

said means mounted on said striker arm comprises a serrated surface.

3. The hand grenade set forth in claim 1 wherein:

said tab is provided with a notch for receiving said firing pin for aiding in holding said lever longitudinally of said body member when said grenade is in an inactivated condition.

4. The hand grenade set forth in claim 1 wherein:

said first and second spring means are in an unbiased condition when the grenade is inactivated.

5. The hand grenade set forth in claim 1 in further combination with:

a second ignitable charge mounted in said body member, and a switch for selectively connecting one of the ignitable charges to said time delay train.

6. The hand grenade set forth in claim 5 wherein: said switch comprises a rotatable dial.

7. The hand grenade set forth in claim 6 wherein: said dial comprises a pair of passageways for selectively connecting the time delay train through one of said passages to one of said ignitable charges.

* * * * *